US008577075B2

(12) United States Patent
Yan

(10) Patent No.: US 8,577,075 B2
(45) Date of Patent: Nov. 5, 2013

(54) SPEAKER

(75) Inventor: Xu-Dong Yan, Shenzhen (CN)

(73) Assignees: AAC Acoustic Technologies (Shenzhen) Co., Ltd., Shenzhen (CN); AAC Technologies PTE.Ltd., Singapore (SG)

( * ) Notice: Subject to any disclaimer, the term of this patent is extended or adjusted under 35 U.S.C. 154(b) by 346 days.

(21) Appl. No.: 12/978,587

(22) Filed: Dec. 26, 2010

(65) Prior Publication Data

US 2011/0293133 A1 Dec. 1, 2011

(30) Foreign Application Priority Data

May 25, 2010 (CN) ..... 2010 1 0182768

(51) Int. Cl.
*H04R 1/00* (2006.01)

(52) U.S. Cl.
USPC ..... 381/407; 381/400; 381/401; 381/402; 381/409; 381/421

(58) Field of Classification Search
USPC ..... 381/400–402, 407, 409, 421
See application file for complete search history.

(56) References Cited

U.S. PATENT DOCUMENTS

| | | | | |
|---|---|---|---|---|
| 6,404,896 | B1 * | 6/2002 | Yoo et al. | 381/401 |
| 7,864,977 | B2 * | 1/2011 | Sadaie et al. | 381/407 |
| 8,031,902 | B2 * | 10/2011 | Takewa | 381/431 |
| 8,155,374 | B2 * | 4/2012 | Yuasa et al. | 381/412 |
| 2005/0069165 | A1 * | 3/2005 | Wu | 381/401 |
| 2008/0137901 | A1 * | 6/2008 | Michno et al. | 381/407 |

* cited by examiner

*Primary Examiner* — Curtis Kuntz
*Assistant Examiner* — Ryan Robinson
(74) *Attorney, Agent, or Firm* — IPro, Inc.; Na Xu

(57) ABSTRACT

A speaker includes a yoke defining a receiving cavity therein, a first magnet received in the receiving cavity of the yoke, a second magnet received in the receiving cavity of the yoke and opposite to the first magnet, a first coil surrounding the first magnet, a second coil surrounding the second magnet, and a diaphragm drove to vibrate by both of the first coil and the second coil. A shape of the first coil is approximately a horse's hoof and defines a first linear side, a flexuous side and a pair of first arc sides coupled with two ends of the first linear side and two ends of the flexuous side.

7 Claims, 3 Drawing Sheets

SPEAKER

FIELD OF THE INVENTION

The present invention generally relates to an electro-acoustic transducer for various types of audio devices or information-communication devices, and more particularly, to a micro speaker having a voice coil.

RELATED ART OF THE INVENTION

Gradually, speakers are widely used in many types of portable electronic devices, such as mobile phones, notebook computers, hearing aids, for converting audio electrical signals to audible sounds.

Generally, a speaker related to the present invention includes one magnetic circuit system. The magnetic circuit system of the speaker only includes one yoke, one magnet assembled in the yoke together with one plate attached to an upper surface thereof, one magnetic gap formed between the yoke and the magnet together with the plate. In correspond with the magnet circuit system, one coil suspended in the magnetic gap and one diaphragm coupled with the coil are provided. The shape of the diaphragm is approximately rectangle. When electrified, the coil drives the diaphragm to vibrate along a vibrating direction. The speaker is being configured to be longer and narrower for meeting the trend of being thinner of the audio devices. However, vibration of the diaphragm along the major axis thereof is not balanced, which seriously affects the quality of the sound produced thereby.

Therefore, an improved speaker that can resolve the problems mentioned-above is desired.

DETAILED DESCRIPTION OF THE EXEMPLARY EMBODIMENT

Reference will now be made to describe one exemplary embodiment of the present invention in detail.

Figure 1:
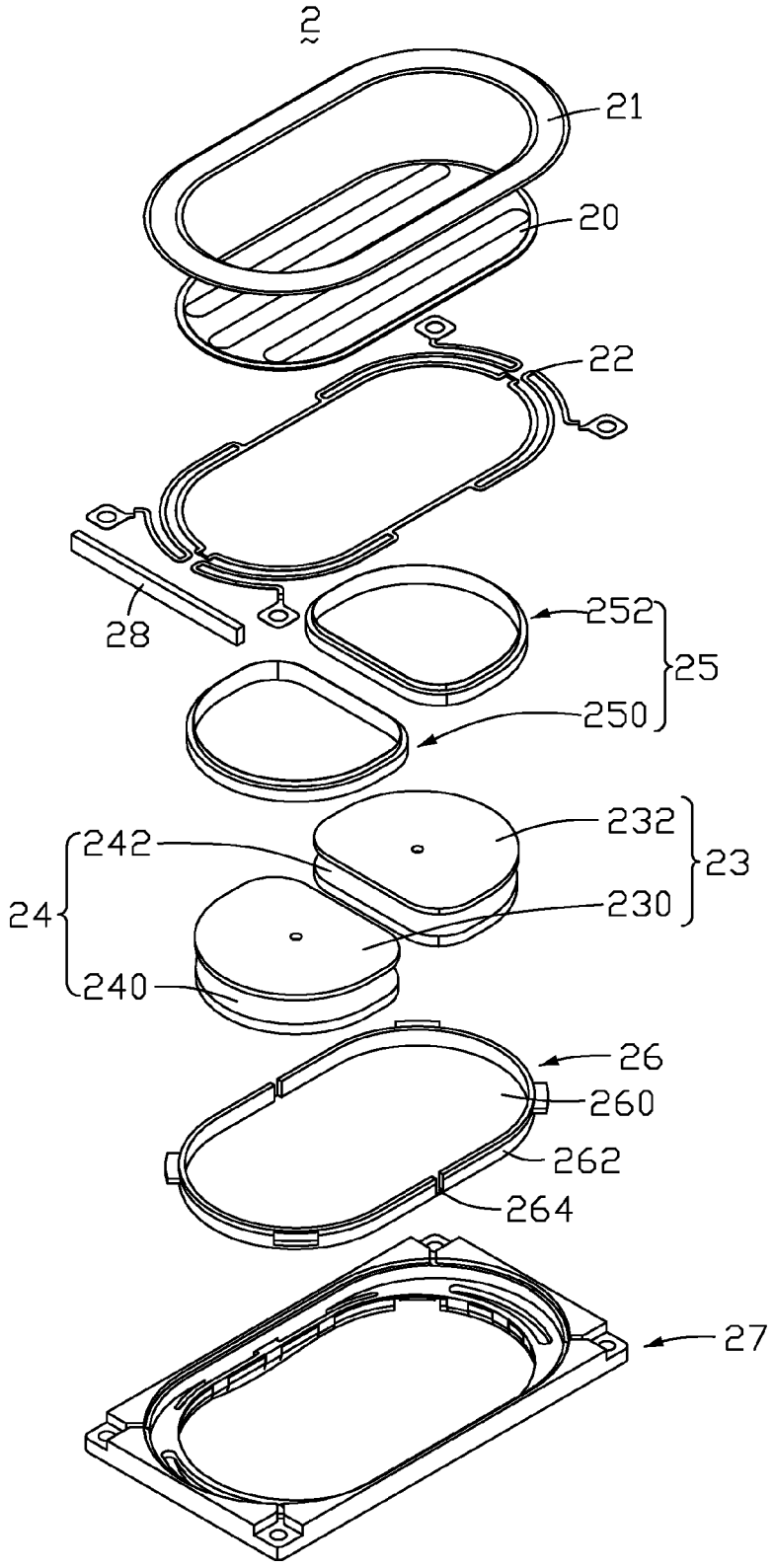
FIG. 1 depicts an isometric exploded view of a speaker in accordance with one exemplary embodiment of the present invention.
Figure 2:
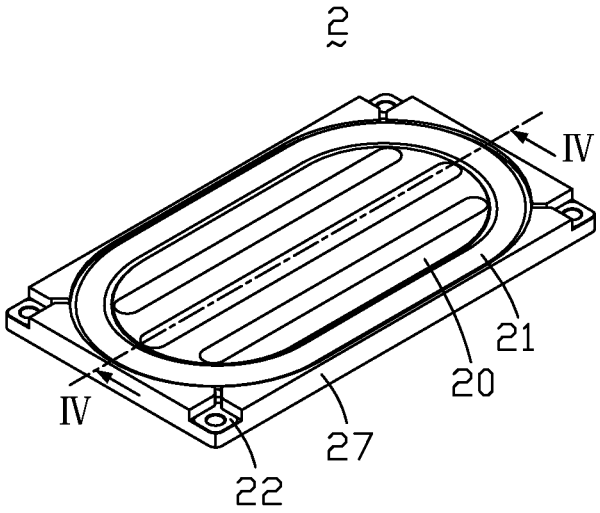
FIG. 2 depicts an isometric assembled view of the speaker in FIG. 1.
Figure 4:
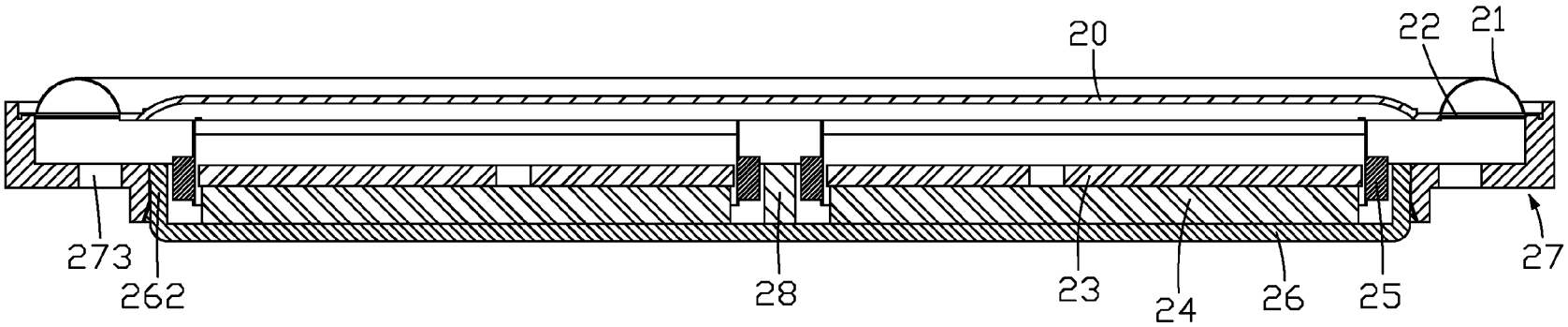
FIG. 4 depicts a cross-sectional view of the speaker taken along Line IV-IV in FIG. 2.

Referring to FIGS. 1, 2 and 4, a speaker 2, in the exemplary embodiment of the present invention, includes a diaphragm, an elastic plate 22 coupled with the diaphragm, a pair of coils 25 for driving the diaphragm to vibrate along a vibrating direction, a yoke 26 defining a receiving cavity, a bar 28 dividing the receiving cavity into two parts, a pair of magnets 24 received in the two parts of the receiving cavity of the yoke 26 respectively, a pair of plates 23 attached to top surfaces of the two magnets 24, a case 27 receiving elements mentioned above.

The case 27 generally is made of plastic and has a center hole for assembling the yoke 26 therein.

The diaphragm includes a center portion 20 and a peripheral portion 21 coupled with the center portion 20. In the exemplary embodiment, the diaphragm is made up of two parts. However, in fact, the diaphragm may be one-piece.

The elastic plate 22 is positioned at a lower portion of the diaphragm.

The yoke 26 defines a bottom 260 and a side 262 surrounding and approximately perpendicular to the bottom 260 for forming the receiving cavity. The side 262 defines a pair of apertures 264 at two opposite middle portions thereof, and the bar 28 is at least partially received in the receiving cavity with two ends fixed in the two apertures 264, by which, the receiving cavity is divided into a first part and a second part. It is preferable that the first part of the receiving cavity and the second part of the receiving cavity are symmetrical about the bar 28.

The pair of magnets 24 includes a first magnet 240 positioned on the bottom 260 in the first part of the receiving cavity, and a second magnet 242 positioned on the bottom 260 in the second part of the receiving cavity. The pair of plates 23 defines a first plate 230 attached to an upper surface of the first magnet 240, and a second plate 232 attached to an upper surface of the second magnet 242.

The bar 28 and the pair of plates 23 are used as magnetizers for forming closed magnetic circuit.

The pair of coils 25 defines a first coil 250 surrounding the first magnet 240 and a second coil 252 surrounding the second magnet 242. And, both of the first coil 250 and the second coil 252 are coupled with the elastic plate 22 for driving the diaphragm to vibrate along the vibrating direction.

Figure 3:
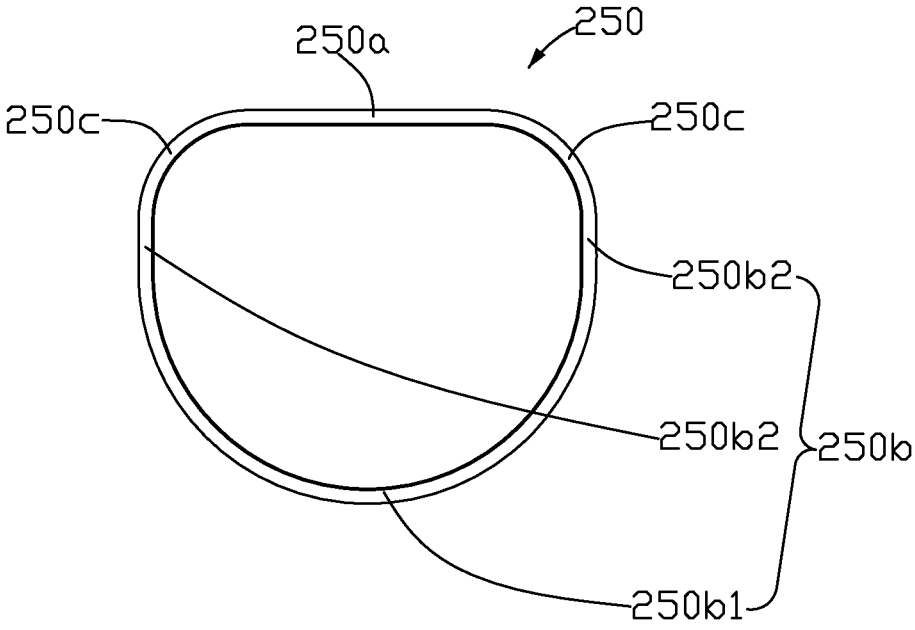
FIG. 3 depicts a top view of a coil of the speaker in FIG. 1.

Referring to FIG. 3, a shape of the first coil 250 is approximately like a horse's hoof, and includes a first linear side 250*a*, a flexuous side 250*b* and a pair of first arc sides 250*c* connecting two ends of the first linear side 250*a* with two ends of the flexuous side 250*b*. In the embodiment, the flexuous side 250*b* comprises a second arc side 250*b*1 facing the first linear side 250*a*, and a pair of second linear sides 250*b*2 connecting the first arc sides 250*c* and the second arc side 250*b*1. The second coil 252 has the same shape to the first coil 250. While assembled, the first coil 250 is symmetrical to the second coil 252 about the bar 28. In addition, shapes of the first magnet 240, the second magnet 242 and the plates 23 correspond to the shape of the first coil 250.

By virtue of the disclosure described above, the diaphragm is driven to vibrate by both of the first coil and the second coil, and the vibration thereof in a long axis direction is stable and balanced.

Be noted that the elastic plate is used for electrically connecting to leads of the coils and further connecting to external circuits, and is not a necessary element to achieve the function or advantage described above. Without the elastic plate, the coils may be directly connected to the diaphragm and the external circuits.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker, comprising:

a yoke;

a first magnet positioned on the yoke;

a second magnet positioned on the yoke and opposite to and apart from the first magnet;

a first coil surrounding the first magnet;

a second coil surrounding the second magnet and having a same shape to the first coil;

a diaphragm driven by the first and second coils;

wherein the first coil defines a first linear side, a flexuous side and a pair of first arc sides connecting two ends of the first linear side and two ends of the flexuous side; and wherein the flexuous side comprises a second arc side facing the first linear side, and a pair of second linear sides connecting the first arc sides and the second arc side.

2. The speaker as described in claim 1, wherein the yoke further defines a bottom and a side surrounding the bottom for forming a receiving cavity, the side being assembled with a bar for dividing the receiving cavity into two parts for receiving the first and second magnets respectively.

3. The speaker as described in claim 2, wherein the side of the yoke defines a pair of apertures at middle portions thereof for fixing two ends of the bar.

4. The speaker as described in claim 2, wherein the first coil and the second coil are symmetrical about the bar.

5. The speaker as described in claim 1 further comprising an elastic plate coupled to a lower part of the diaphragm, the elastic plate being electrically connected to the coils.

6. The speaker as described in claim 5, wherein the elastic plate is located between the diaphragm and the coils.

7. A speaker comprising a magnetic circuit, coils partially suspended in the magnetic circuit, and a diaphragm driven by the coils to vibrate along a vibrating direction, each of the coils comprising:

a linear end;

an arcuate end facing the linear end; and a pair of curved portions connecting two ends of the linear end and two ends of the arcuate end wherein each of the curved portion of the coil further comprises an arc connecting to the linear end and a straight line connecting to the arcuate end.

* * * * *